US005947804A

United States Patent [19]

Fukinuki et al.

[11] Patent Number: 5,947,804

[45] Date of Patent: Sep. 7, 1999

[54] ADJUSTABLE ECCENTRICITY ORBITAL TOOL

[75] Inventors: Masatoshi Fukinuki, Fucho, Japan; John E. Nemazi, Bloomfield Hills; Jeremy J. Curcuri, Southfield, both of Mich.

[73] Assignee: Ryobi North America, Inc., Anderson, S.C.

[21] Appl. No.: 09/067,109

[22] Filed: Apr. 27, 1998

[51] Int. Cl.[6] ..... B24B 23/00; B24B 27/08

[52] U.S. Cl. ..... 451/357; 451/342; 451/344

[58] Field of Search ..... 451/342, 344, 451/343, 357, 359, 431, 441, 514, 516, 518, 519, 520, 521, 353

[56] References Cited

U.S. PATENT DOCUMENTS

| | | | |
|---|---|---|---|
| Re. 33,335 | 9/1990 | Gentischer . | |
| 2,621,433 | 12/1952 | Boyle . | |
| 3,364,625 | 1/1968 | Sogge . | |
| 3,874,125 | 4/1975 | Stroezel . | |
| 4,671,020 | 6/1987 | Hutchins . | |
| 4,729,194 | 3/1988 | Maier et al. . | |
| 4,744,177 | 5/1988 | Braun et al. . | |
| 4,920,702 | 5/1990 | Kloss et al. . | |
| 5,123,216 | 6/1992 | Kloss et al. . | |
| 5,167,095 | 12/1992 | Berger . | |
| 5,349,786 | 9/1994 | Dorrah . | |
| 5,357,715 | 10/1994 | Hiramatsu . | |
| 5,392,568 | 2/1995 | Howard, Jr. . | |
| 5,496,207 | 3/1996 | Hornung et al. | 451/357 |
| 5,595,531 | 1/1997 | Niemela et al. | 451/357 |

FOREIGN PATENT DOCUMENTS

| | | |
|---|---|---|
| 3805926A1 | 7/1988 | Germany . |
| 4118392A1 | 10/1992 | Germany . |

*Primary Examiner*—David A. Scherbel
*Assistant Examiner*—Derris H. Banks
*Attorney, Agent, or Firm*—Brooks & Kushman P.C.

[57] ABSTRACT

An orbital sander includes a motor, a housing, and a drive shaft rotatably driven by the motor about a drive axis. A bearing freely rotatable about a bearing axis is disposed eccentrically with respect to the drive axis to define an eccentric offset. A sanding platen is supported by the bearing. An input sleeve is interposed between the bearing and the drive shaft, and has an input axis spaced from the drive axis. An output sleeve, positioned within and engaging the bearing, encircles the input sleeve and is rotatable about the input axis. The sleeves are circumferentially aligned, thereby minimizing the height of the sander. A stop member cooperates with the sleeves to allow for rotation of the sanding platen while preventing axial movement of the sleeves. The sleeves have cooperating surfaces which limit their relative movement, defining maximum and minimum eccentric offsets based on the direction of motor rotation. An alternative embodiment provides cooperating surfaces which are capable of being separated, thus providing more than two possible eccentric offsets without requiring reversal of the direction of motor rotation.

13 Claims, 6 Drawing Sheets

Fig. 8
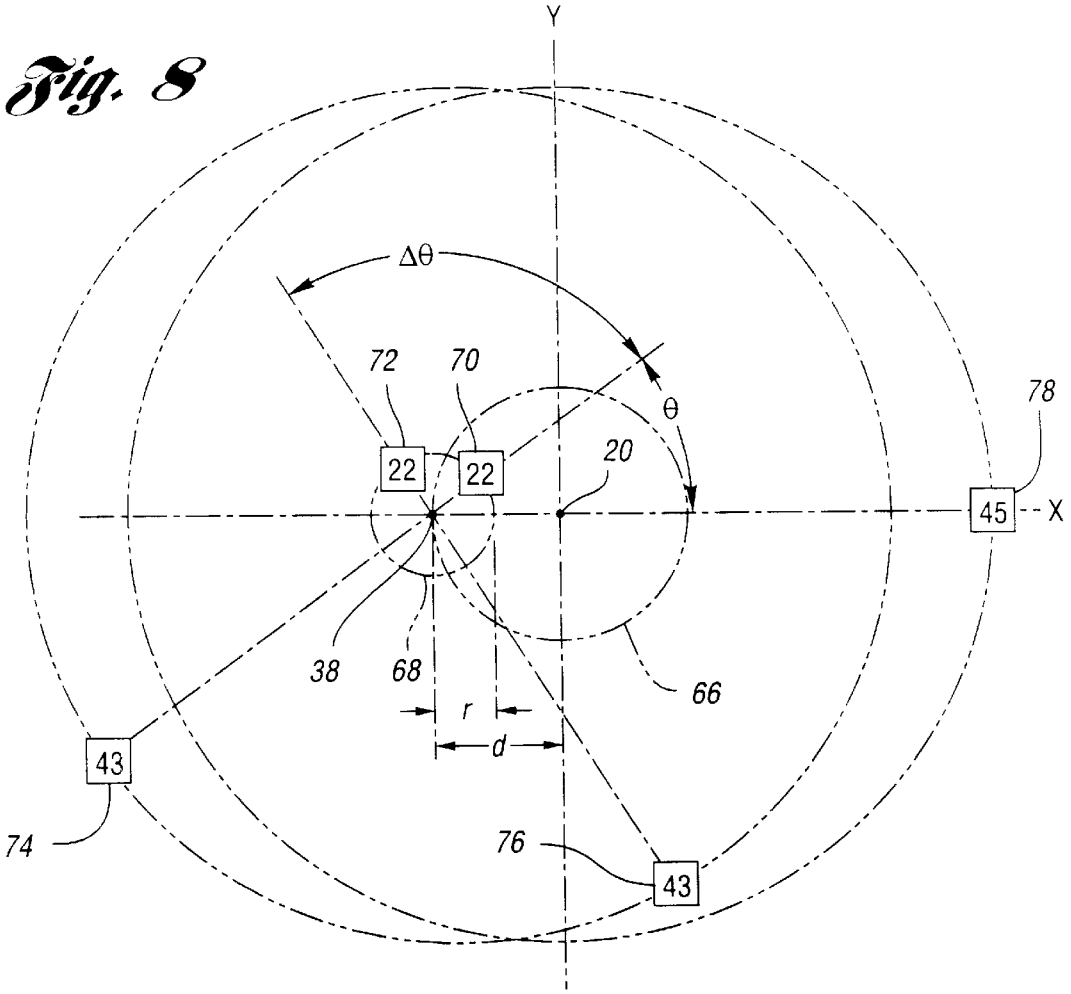
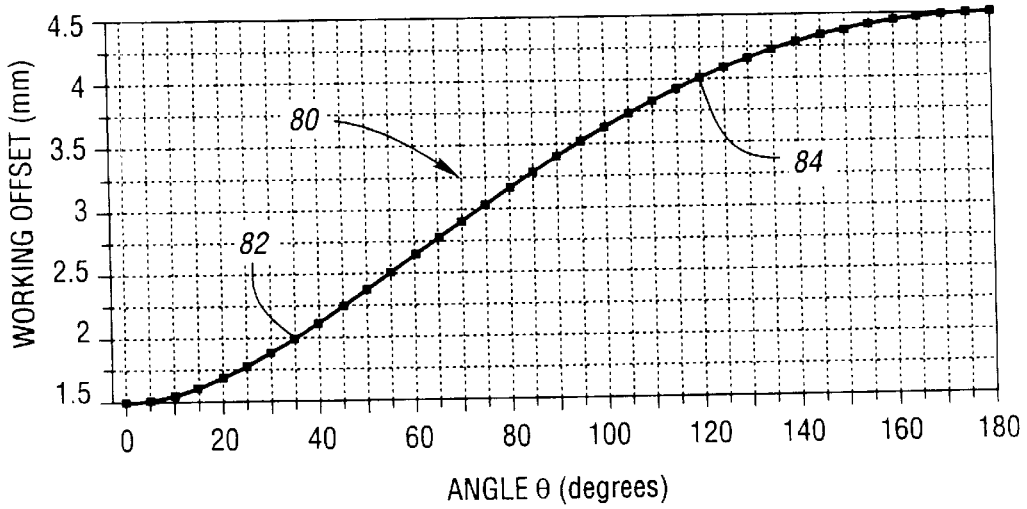
Fig. 9

ADJUSTABLE ECCENTRICITY ORBITAL TOOL

TECHNICAL FIELD

The present invention relates to an orbital tool, and in particular to an orbital sander providing multiple eccentric orbits of the sanding platen to allow for the selection of different stock removal rates. This application also relates to co-pending U.S. patent application Ser. No. 09/067,108, filed on the same day as this application, naming Nobuto Kai, Masatoshi Fukinuki, John Nemazi, and Jeremy Curcuri as inventors, entitled "Orbital Tool", and having attorney docket number RMP 0552 PUS, which is hereby incorporated by reference in its entirety.

BACKGROUND ART

An orbital sander achieves an eccentric sanding motion through linkage of its motor to a sanding platen via an off-axis bearing. In conventional orbital sanders, an eccentric member is fixed to the drive shaft of the motor, thereby defining a single eccentric orbit. Depending on the nature of this orbit, such a sander is suitable either specifically for coarse sanding work or for fine sanding work.

Various attempts have been made to provide a sander capable of performing both coarse and fine sanding tasks. For example, U.S. Pat. No. 3,364,625 to Sogge and U.S. Pat. No. 5,357,715 to Hiramatsu disclose sanders capable of operating in an orbital mode as a well as a stationary mode. Through gearing or reversal of the direction of motor rotation, these sanders permit the use of an orbital motion for fine sanding work and a stationary rotation of the sanding platen for faster stock removal. Alternatively, U.S. Pat. No. 3,874,125 to Stroezel discloses a sander capable of converting from an orbital motion to a reciprocatory motion in response to a reversal in the direction of motor rotation.

Using a different approach, U.S. Pat. No. 4,744,177 to Braun et al. discloses an orbital sander in which the direction of motor rotation determines which of two different eccentric orbits of the sanding platen is selected. Although this sander allows for both coarse and fine sanding work while still maintaining the benefit of an orbital motion, the sander is configured such that the eccentric mechanism substantially increases the overall height of the sander, thereby hindering its operability. Furthermore, the eccentric member is supported by elastic elements between the platen and sander housing, precluding use of the sander in a random orbital mode.

DISCLOSURE OF THE INVENTION

It is an object of the present invention to provide an orbital sander having multiple eccentric orbits of the sanding platen allowing the user to vary the stock removal rate to be suitable for both coarse and fine sanding work.

It is another object of the present invention to provide an orbital sander having a mechanical coupling which acts to define multiple eccentric orbits of the sanding platen without increasing the overall height of the sander.

It is a further object of the present invention to provide an orbital sander having an eccentric mechanism which is supported axially so as to allow the sander to operate in a random orbit mode.

Accordingly, an orbital sander is provided which includes a motor, a housing, and a drive shaft rotatably driven by the motor about a drive axis. A bearing freely rotatable about a bearing axis is disposed parallel to and eccentrically with respect to the drive axis to define an eccentric offset between the bearing axis and the drive axis. A sanding platen is supported by the bearing and has a planar surface adapted to receive sandpaper. An input sleeve is interposed between the bearing and the drive shaft, is driven by the drive shaft, and has an input axis spaced from the drive axis. An output sleeve, positioned within and engaging the bearing, may be rotated about the input axis. The output sleeve encircles the input sleeve such that the sleeves are circumferentially aligned so as to minimize the height of the sander. The output and input sleeves have cooperating surfaces which limit the relative movement of the sleeves, such that rotation of the motor in a first direction causes the cooperating surfaces to engage in a first limit position such that the eccentric offset is at a maximum, and rotation of the motor in a second direction causes the cooperating surfaces to engage in a second limit position such that the eccentric offset is at a minimum. A stop member is provided which cooperates with the input and output sleeves to allow for rotation of the sanding platen while preventing axial movement of the input and output sleeves.

In one embodiment, the sander is provided with arcuate slots on one sleeve sized to receive pins provided on the other sleeve. As the motor rotates, the pin is forced to abut an end of each slot, thereby defining a maximum eccentric orbit of the sanding platen. Reversal of the direction of motor rotation results in the pin abutting the opposite end of the slot, defining a minimum eccentric orbit of the sanding platen.

In an alternative embodiment, the sander is provided with multiple depressions on one sleeve sized to receive a pins provided on the other sleeve. This embodiment requires that the cooperating surfaces are capable of being separated from one another, and provides a spring for biasing the surfaces into engagement during operation of the sander. This configuration provides more than two possible eccentric orbits of the sanding platen without requiring reversal of the direction of motor rotation.

The above objects and other objects, features, and advantages of the present invention are more readily understood from a review of the attached drawings and the accompanying specification and claims.

BRIEF DESCRIPTION OF THE DRAWINGS

FIG. 8 is a diagram illustrating first and second balance masses selected and positioned in accordance with the present invention; and FIG. 9 is a graph depicting eccentric offset versus output sleeve angular position, in an exemplary embodiment of the present invention.

BEST MODE FOR CARRYING OUT THE INVENTION

Figure 1:
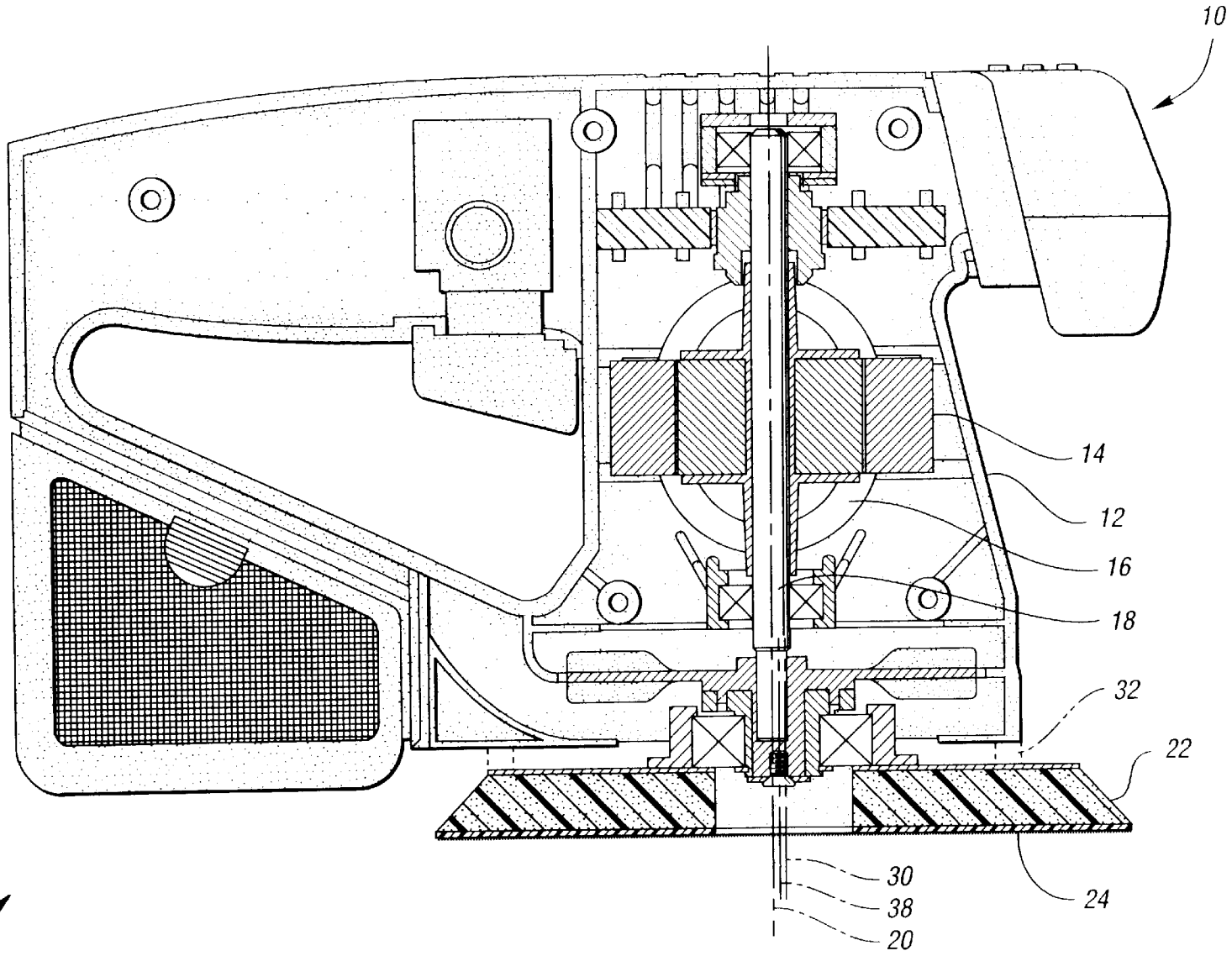
FIG. 1 shows a cross-sectional view of the orbital sander of the present invention.

Referring first to FIG. 1, there is shown a cross-sectional view of an orbital sander 10 made in accordance with the present invention. Sander 10 comprises a housing 12 for supporting a motor 14, where motor 14 includes an armature 16 having a drive shaft 18 associated therewith. Drive shaft 18 is rotatably driven by motor 14 about a drive axis 20. Sander 10 also includes a sanding platen 22 having a lower planar surface 24 adapted to receive sandpaper. Platen 22 is secured to a bearing 26 disposed eccentrically with respect to drive shaft 18. A mechanical coupling 28, interposed between and affixed to drive shaft 18 and bearing 26, acts as an eccentric drive mechanism to convert rotation of drive shaft 18 into orbital movement of platen 22. Bearing 26 and connected platen 22 are freely rotatable about a bearing axis 30, allowing sander 10 to function in a random orbital mode. Alternatively, platen 22 may be connected to housing 12 by a pair of elastic elements 32 so that only an orbital motion of platen 22 is permitted.

Figure 2:
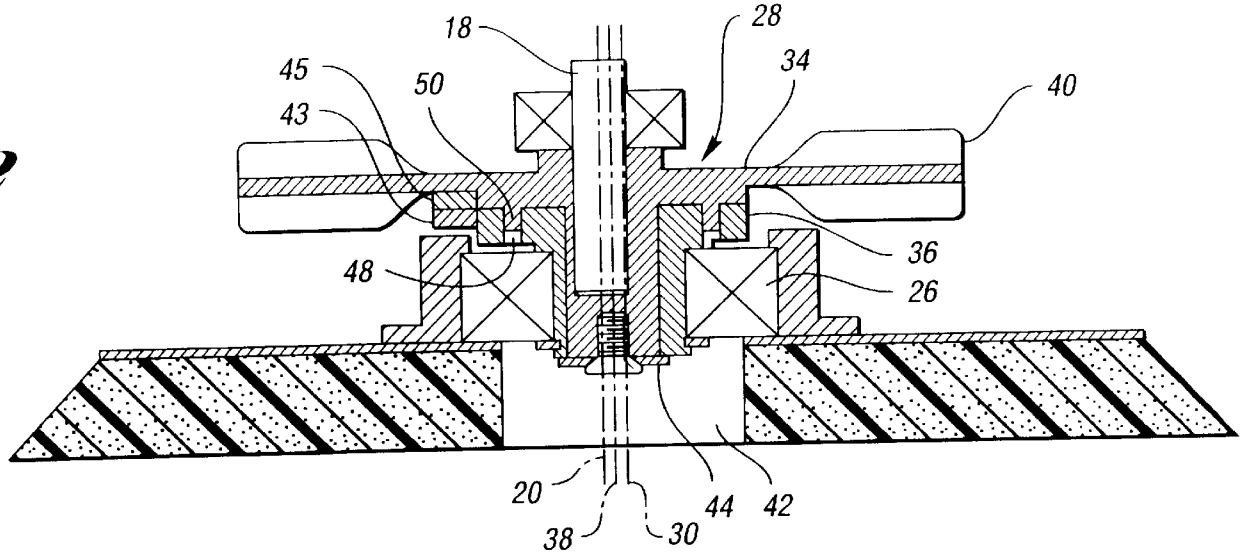
FIG. 2 is an enlarged, fragmentary view of the dual eccentric sleeve configuration.

Referring now to FIG. 2, there is shown an enlarged, fragmentary view of one embodiment of the present invention. Preferably, mechanical coupling 28 consists of an input sleeve 34 encircled by an output sleeve 36. Input sleeve 34 and output sleeve 36 are circumferentially aligned such that the height of sander 10 is minimized. This configuration improves the operability of sander 10 as compared with sanders which must be controlled from a height far above the workpiece. Input sleeve 34 is press-fit onto drive shaft 18, is driven by drive shaft 18 about drive axis 20, and has an input axis 38 which is offset a fixed distance from drive axis 20. In the preferred embodiment, input sleeve 34 is formed integrally with a combined motor cooling and dust collection fan 40. Output sleeve 36 engages bearing 26, has an axis coaxially aligned with bearing axis 30, and may be rotated about input axis 38.

As illustrated in FIG. 2, platen 22 is provided with a hollow central portion 42 through which a flat washer 44 is secured to input sleeve 34. Washer 44 functions as a stop member to prevent axial movement of input sleeve 34 or output sleeve 36 while still allowing free rotation of platen 22. This means of axial support to sleeves 34 and 36 permits random orbital motion of sander 10, as opposed to sanders where the eccentric mechanism is supported via radially-placed elements. A first balance mass 43 is positioned to rotate together with output sleeve 36, while a second balance mass 45 is positioned to rotate together with input sleeve 34.

Figure 3:
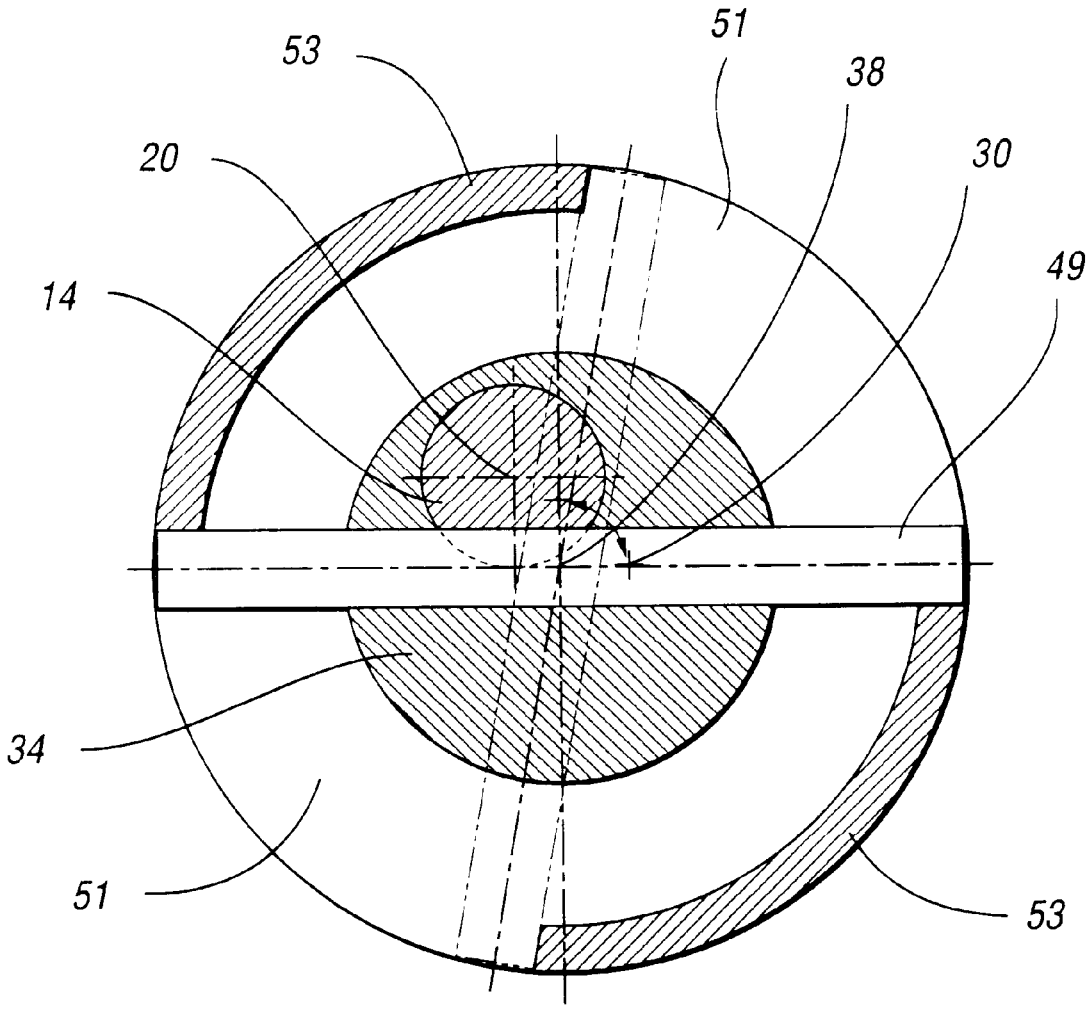
FIG. 3 is a cross-sectional view of an alternative pin and slot configuration.

For sander 10, an eccentric offset 46 is defined by the distance between drive axis 20 and bearing axis 30. Relative movement of input sleeve 34 and output sleeve 36 will vary eccentric offset 46, and therefore the eccentric orbit of platen 22, thereby enabling a user to vary the stock removal rate of sander 10. In the embodiment shown in FIGS. 2 and 3, output sleeve 36 includes two arcuate slots 48 adapted for slidable engagement with two pins 50 provided on input sleeve 34. In the preferred embodiment, slots 48 are diametrically opposed and extend 90 degrees, thereby limiting the relative movement of output sleeve 36 with respect to input sleeve 34. Alternatively, as shown in FIG. 3, a pin 49 may be provided which extends through input sleeve 34. Pin 49 may move within arcuate slots 51 provided within output sleeve 36 over a finite angle restricted by stops 53.

Figure 4B:
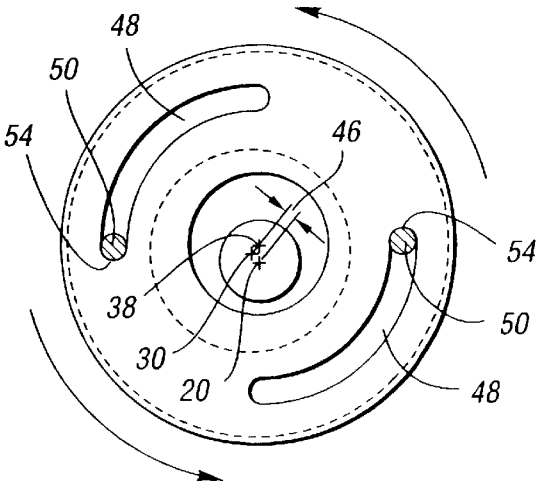
FIGS. 4*a* and 4*b* are schematic representations of the sleeve configuration when the eccentric offset is maximum and minimum, respectively.
Figure 4A:
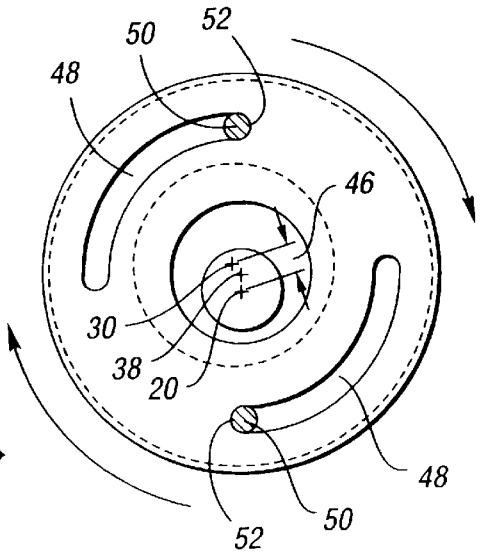

As shown schematically in FIG. 4, the direction of rotation of drive shaft 18, denoted by arrows, will determine the value of eccentric offset 46. For example, when drive shaft 18 is rotating in a clockwise direction, as in FIG. 4*a*, pins 50 are urged into engagement with a first end 52 of each slot 48 causing eccentric offset 46, and therefore the eccentric orbit of platen 22, to be at a maximum. Alternatively, when drive shaft 18 is rotating in a counterclockwise direction, as in FIG. 4*b*, pins 50 are urged into engagement with a second end 54 of each slot 48, causing eccentric offset 46, and therefore the eccentric orbit of platen 22, to be at a minimum. Therefore, by simply reversing the direction of rotation of drive shaft 18, sander 10 can function in a random orbital fashion to accomplish either course or fine sanding tasks.

Figure 5A:
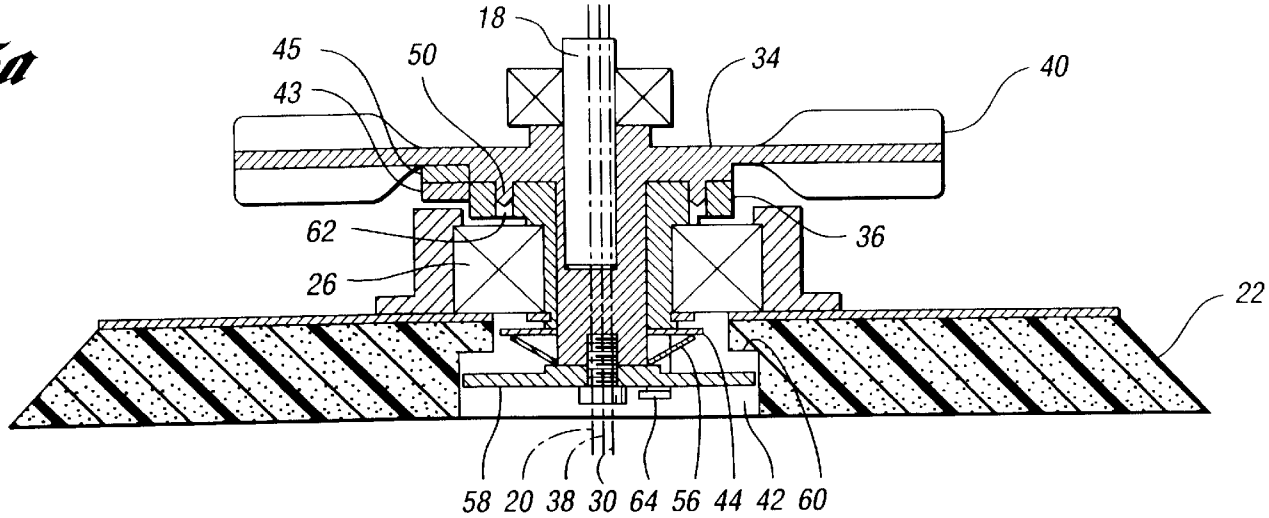
FIGS. 5*a* and 5*b* are enlarged, fragmentary views of an alternative embodiment of the dual eccentric sleeve configuration with the cooperating surfaces engaged and separated, respectively.
Figure 5B:
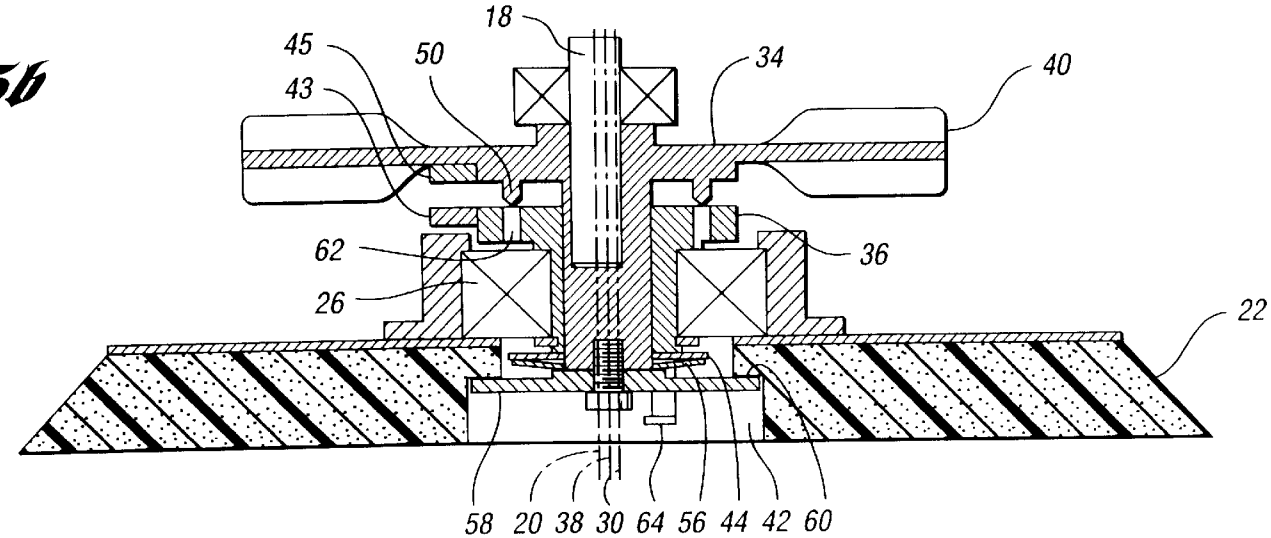

FIGS. 5*a* and 5*b* show a fragmentary view of an alternative embodiment of the present invention. In this embodiment, input sleeve 34 and output sleeve 36 are capable of being separated and rotated with respect to one another in order to vary eccentric offset 46 without reversing the direction of rotation of drive shaft 18. During operation of sander 10, as depicted in FIG. 5*a*, sleeves 34 and 36 are biased into engagement by a spring, preferably a Belleville washer 56. Belleville washer 56 is affixed to input sleeve 34 and engages flat washer 44 to prevent axial movement of sleeves 34 and 36. A winged stop member 58 is mounted on input sleeve 34 below Belleville washer 56. As shown in FIG. 5*b*, winged stop member 58 acts to limit the relative rotation of input sleeve 34 and platen 22 through contact with a ledge 60 formed within hollow central portion 42 of platen 22.

Figure 6A:
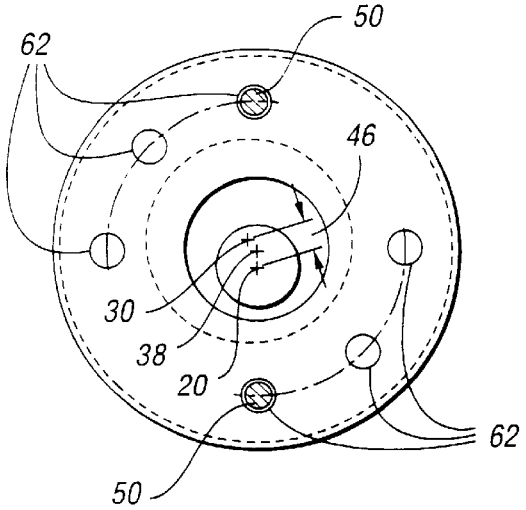
FIGS. 6*a*, 6*b* and 6*c* are schematic representations of the sleeve configuration of FIG. 4 when the eccentric offset is maximum, intermediate, and minimum, respectively.
Figure 6B:
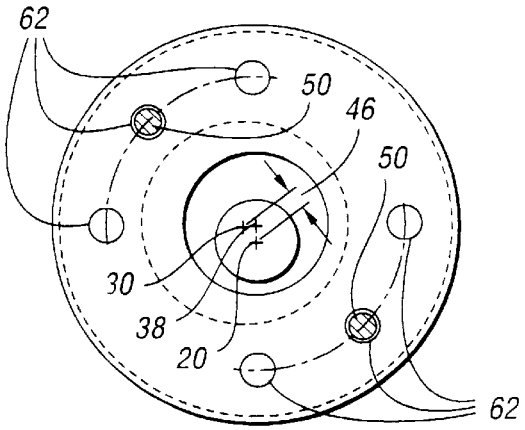
Figure 6C:
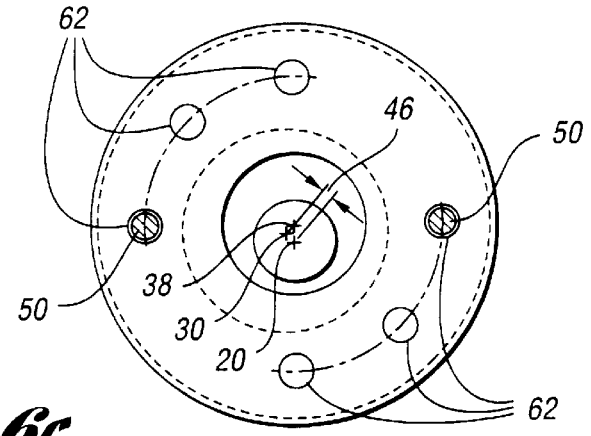

As shown in FIGS. 5 and 6, output sleeve 36 is provided with a plurality of depressions 62 which are diametrically opposed and sized to receive pins 50 protruding from input sleeve 34. Preferably, pins 50 are tapered so as to facilitate insertion into depressions 62. During operation of sander 10, pins 50 are spring-biased into engagement with depressions 62 in one of several positions. Separation of input sleeve 34 and output sleeve 36, as shown in FIG. 5*b*, causes winged stop member 58 to engage ledge 60, thereby holding input sleeve 34 stationary. Then, output sleeve 36 may be rotated using an indicator extension 64 descending from flat washer 44 affixed to output sleeve 36. Rotation of output sleeve 36 with respect to input sleeve 34 about input axis 38 allows for the selection of a new engagement position of pins 50, thereby changing eccentric offset 46. Shown schematically in FIGS. 6*a*, 6*b*, and 6*c* are the maximum, intermediate, and minimum eccentric offsets 46, respectively, defined when three sets of depressions 62 are provided on output sleeve 36. Consequently, in this embodiment, more than two values of eccentric offset 46, and therefore the eccentric orbit of platen 22, may be provided without requiring a reversal in the direction of rotation of drive shaft 18.

Figure 7:
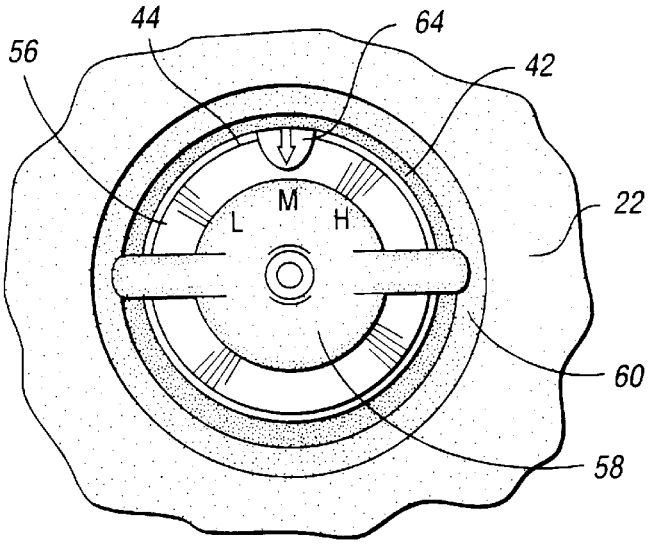
FIG. 7 is a bottom, fragmentary view of the sander showing the offset adjustment mechanism for the sleeve configuration of FIG. 4.

Shown in FIG. 7 is an enlarged, bottom view of winged stop member 58 used to select eccentric offset 46. Winged stop member 58 is stamped with low (L), medium (M), and high (H) settings corresponding to the minimum, intermediate, and maximum values of eccentric offset 46, respectively, shown in FIG. 6. Upon separating output sleeve 36 from input sleeve 34 and holding input sleeve 34 stationary through contact of winged stop member 58 with ledge 60, a user may shift indicator extension 64 between settings in order to select the appropriate stock removal rate of sander 10.

With reference to FIG. 8, a diagram illustrates first 43 and second 45 balance masses selected and positioned in accordance with the present invention. Input axis 38 rotates about drive axis 20 along circle 66 as drive shaft 18 is rotated. Bearing axis 30 is selectively rotatable about circle 68 with output sleeve 36, as output sleeve 36 is selectively rotated about input axis 38. To facilitate an understanding of the present invention, only two positions of sanding platen 22 are illustrated. However, it is to be appreciated that embodiments of the present invention provide balanced operation for sanding platen 22 at all positions on circle 68.

Sanding platen 22 in an exemplary first position is shown at 70; sanding platen 22 in an exemplary second position is shown at 72. First balance mass 43 is positioned to rotate together with output sleeve 36 and sanding platen 22 about input axis 38. First balance mass 43 in a first position corresponding to first position 70 of sanding platen 22 is indicated at 74. First balance mass 43 in a second position corresponding to second position 72 of sanding platen 22 is indicated at 76. First balance mass 43 is selected and positioned to balance sanding platen 22 about input axis 38. That is, first balance mass 43 is selected based in part on a first distance r defined between input axis 38 and bearing axis 30 (on circle 68) to substantially minimize the moments of mass about input axis 38 due to sanding platen 22.

For example, for a sanding platen mass of 100 g and a first distance r of 1.5 mm, a first balance mass of about 7.5 g may be selected and positioned about 20 mm from input axis 38 diametrically opposite sanding platen 22 to substantially minimize the moments of mass about input axis 38 due to sanding platen 22. Of course, the desired mass and/or position of first balance mass 43 may vary based on other masses which rotate together with output sleeve 36 about input axis 38. Further, it is to be appreciated that the mass and position are inversely proportional to each other and that the mass is selected and positioned such that the moments of mass about input axis 38 are each about zero. The values given above are merely exemplary.

Second balance mass 45 is positioned to rotate together with input sleeve 34 about drive axis 20. Second balance mass 45 is selected and positioned at 78 to balance sanding platen 22 and first balance mass 43 about drive axis 20. That is, second balance mass 45 is selected based in part on a second distance d defined between drive axis 20 and input axis 38 to substantially minimize the moments of mass about drive axis 20 due to first balance mass 43 and sanding platen 22.

For example, for a sanding platen mass of 100 g, a first balance mass of 7.5 g, and a second distance d of 3.0 mm, a second balance mass of about 16.1 g may be selected and positioned about 20 mm from drive axis 20 diametrically opposite input axis 38 to substantially minimize the moments of mass about drive axis 20 due to sanding platen 22 and first balance mass 43. Of course, the desired mass and/or position of second balance mass 45 may vary based on other masses which rotate together with input sleeve 34 about drive axis 20. Further, it is to be appreciated that the mass and position are inversely proportional to each other and that the mass is selected and positioned such that the moments of mass about drive axis 20 are each about zero. The values given above are merely exemplary.

In the exemplary embodiment described above, with a first distance r of 1.5 mm, and a second distance d of 3.0 mm, the first distance r is advantageously less than the second distance d. In addition to balanced operation at all selectable eccentricities, the lesser first distance r reduces the moment of inertia about input axis 38 due to first balance mass 43 and sanding platen 22. The reduced moment of inertia makes embodiments of the present invention practical by reducing component loading and wear, particularly when the motor rotational direction determines eccentric offset 46. Further, the first distance r being less than the second distance d allows more versatility for different eccentricities while facilitating construction of sander 10.

With reference to FIG. 9, a graph depicts the eccentric offset (mm) versus output sleeve angular position (degrees), in an exemplary embodiment of the present invention having a first distance r of about 1.5 mm, and a second distance d of about 3.0 mm. The eccentric offset as a function of angle is generally indicated at 80. In an embodiment in which output sleeve 36 is selectively rotated over a finite angle by reversing motor rotational direction, the finite angle is preferably less than 180 degrees. Further, the finite angle is preferably not more than 90 degrees with the maximum eccentric offset being about twice the value of the minimum eccentric offset. In the exemplary embodiment depicted in FIGS. 8 and 9, the finite angle is about 85 degrees and is indicated at $\Delta\theta$ (FIG. 8), with a minimum eccentric offset of about 2.0 mm indicated at point 82 (FIG. 9), and a maximum eccentric offset of about 4.0 mm indicated at point 84 (FIG. 9).

It is to be appreciated that an eccentric offset function R may be described by the following equation:

$$R = \sqrt{d^2 - 2dr\cos(\theta) + r^2}$$

wherein r is the first distance defined between input axis 38 and bearing axis 30, d is the second distance defined between drive axis 20 and input axis 38, and e is the angular position of bearing axis 30 with respect to input axis 38.

It is understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed.

What is claimed is:

1. A random orbital sander comprising:

a housing;

a motor disposed within the housing, the motor capable of rotating in a first direction and a second direction;

a drive shaft rotatably driven by the motor about a drive axis;

a bearing freely rotatable about a bearing axis and disposed parallel to and eccentrically with respect to the drive axis to define an eccentric offset between the bearing axis and the drive axis;

a sanding platen supported by the bearing, the sanding platen having a planar surface adapted to receive sandpaper;

an input sleeve interposed between the bearing and the drive shaft and driven by the drive shaft, the input sleeve having an input axis spaced from the drive axis;

an output sleeve encircling the input sleeve and positioned within and engaging the bearing, the output sleeve being rotatable about the input axis, the output sleeve circumferentially aligned with the input sleeve in order to minimize the height of the sander; and a stop member cooperating with the output and input sleeves to allow for rotation of the sanding platen while preventing axial movement of the input and output sleeves;

wherein the output and input sleeves have cooperating surfaces which limit the relative movement of the sleeves, such that rotation of the motor in the first direction causes the cooperating surfaces to engage in a first limit position such that the eccentric offset is at a maximum, resulting in a large eccentric orbit and a maximum stock removal rate, and rotation of the motor in the second direction causes the cooperating surfaces to engage in a second limit position such that the eccentric offset is at a minimum, resulting in a smaller eccentric orbit and a minimum stock removal rate.

2. The sander of claim 1, wherein the cooperating surfaces include at least one pin located on one of the surfaces, and at least one slot located on the other surface for receiving the at least one pin.

3. The sander of claim 1, further comprising a fan formed integrally with the input sleeve.

4. The sander of claim 1 further comprising a first balance mass positioned to rotate together with the output sleeve about the input axis, the first balance mass being selected and positioned based in part on a first distance defined between the input axis and the bearing axis to substantially minimize the moments of mass about the input axis due to the sanding platen; and a second balance mass positioned to rotate together with the input sleeve about the drive axis, the second balance mass being selected and positioned based in part on a second distance defined between the drive axis and the input axis to substantially minimize the moments of mass about the drive axis due to the first balance mass and the sanding platen, wherein the first distance is less than the second distance to reduce the moment of inertia about the input axis due to the first balance mass and the sanding platen.

5. An orbital sander comprising:

a housing;

a motor disposed within the housing;

a drive shaft rotatably driven by the motor about a drive axis;

a bearing freely rotatable about a bearing axis and disposed parallel to and eccentrically with respect to the drive axis to define an eccentric offset between the bearing axis a nd the drive axis;

a sanding platen supported by the bearing, the platen having a planar surface adapted to receive sandpaper;

a mechanical coupling interposed between the bearing and the drive shaft, the coupling comprising an input element driven by the drive shaft and an output element engaging the bearing, the coupling cooperating to vary the eccentric offset and therefore the eccentric orbit of the sanding platen to allow for variation in the stock removal rate, the input and output elements having cooperating surfaces which fix the eccentric offset thereby allowing for selection of multiple stock removal rates, wherein the cooperating surfaces are capable of being separated from each other; and a spring for biasing the cooperating surfaces into engagement during operation of the sander.

6. The sander of claim 5, further comprising a stop member cooperating with the input and output elements to allow for rotation of the sanding platen while preventing axial movement of the input and output elements.

7. The sander of claim 5 wherein the sanding platen is free to rotate about the bearing imparting a random orbital motion.

8. The sander of claim 5 wherein the input element comprises an input sleeve and the output element comprises an output sleeve encircling and circumferentially aligned with the input sleeve so that the height of the sander is minimized.

9. The sander of claim 8, wherein the input sleeve has an input axis spaced from the drive axis, and the output sleeve is rotatable about the input axis.

10. The sander of claim 9 further comprising a first balance mass positioned to rotate together with the output sleeve about the input axis, the first balance mass being selected and positioned based in part on a first distance defined between the input axis and the bearing axis to substantially minimize the moments of mass about the input axis due to the sanding platen; and a second balance mass positioned to rotate together with the input sleeve about the drive axis, the second balance mass being selected and positioned based in part on a second distance defined between the drive axis and the input axis to substantially minimize the moments of mass about the drive axis due to the first balance mass and the sanding platen, wherein the first distance is less than the second distance to reduce the moment of inertia about the input axis due to the first balance mass and the sanding platen.

11. The sander of claim 5, wherein the cooperating surfaces include at least one pin located on one of the surfaces, and a plurality of depressions located on the other surface for receiving the at least one pin.

12. The sander of claim 5, wherein the spring is a Belleville washer.

13. The sander of claim 5, further comprising a fan formed integrally with the input sleeve.

* * * * *